US006082257A

United States Patent [19]

Secor

[11] Patent Number: 6,082,257

[45] Date of Patent: Jul. 4, 2000

[54] PRINTING UNIT WITH ANILOX ROLLER BEARER POSITIONING

[75] Inventor: Howard C. Secor, Krum, Tex.

[73] Assignee: Howard W. DeMoore, Dallas, Tex.

[21] Appl. No.: 09/136,860

[22] Filed: Aug. 19, 1998

[51] Int. Cl.[7] ..... B41F 11/08

[52] U.S. Cl. ..... 101/137; 101/185; 101/350.3; 101/351.1; 101/352.01; 118/259

[58] Field of Search ..... 101/348, 350.1, 101/350.2, 350.3, 350.4, 351.1–351.4, 352.01–352.05, 137, 139, 140, 182, 184, 185, 192, 218; 118/259, 261

[56] References Cited

U.S. PATENT DOCUMENTS

| | | | |
|---|---|---|---|
| 3,196,788 | 7/1965 | Knowles | 101/217 |
| 3,732,814 | 5/1973 | Pasquinelli | 101/218 |
| 4,233,899 | 11/1980 | Rebel | 101/142 |
| 4,240,346 | 12/1980 | Landis et al. | 101/139 |
| 4,391,191 | 7/1983 | Bolza-Schunemann | 101/216 |
| 4,643,090 | 2/1987 | McKrell et al. | 101/218 |
| 4,756,247 | 7/1988 | Schwartz et al. | 101/177 |
| 4,878,427 | 11/1989 | Washchynsky et al. | 101/219 |
| 5,388,490 | 2/1995 | Buck | 83/880 |
| 5,630,363 | 5/1997 | Davis et al. | 101/141 |
| 5,651,316 | 7/1997 | DeMoore et al. | 101/450.1 |
| 5,813,345 | 9/1998 | Fuller et al. | 101/463.1 |

*Primary Examiner*—John Hilten
*Assistant Examiner*—Dave A. Ghatt
*Attorney, Agent, or Firm*—Locke Liddell & Sapp LLP

[57] ABSTRACT

A printing unit is disclosed which incorporates an applicator roller (66) such as anilox roller with bearer surfaces (206) at the ends thereof for positively positioning the applicator roller relative a cylinder, such as a plate cylinder (32) or a blanket cylinder (34). The bearer surfaces (206) on the applicator roller are engaged with the bearer surfaces (202, 204) of the plate or impression cylinder to precisely and consistently position the applicator roller (66) relative the cylinder.

8 Claims, 6 Drawing Sheets

PRINTING UNIT WITH ANILOX ROLLER BEARER POSITIONING

TECHNICAL FIELD OF THE INVENTION

This invention relates to a printing unit using an anilox roller, and in particular to positioning of the anilox roller within the printing unit.

BACKGROUND OF THE INVENTION

It is common to apply an ink or coating or other liquid material to a cylinder or other surface within a printing unit by contacting the cylinder with an anilox roller. The anilox roller has an outer surface with a series of very precise depressions or dimples which permit a liquid, such as an ink or coating, to be applied to the roller as the surface of the roller passes through a reservoir of the liquid and then transfer a controlled amount of the liquid to another cylinder, such as delivery, printing or blanket cylinder.

It is often an advantage to be able to move the anilox roller into and out of engagement with the cylinder in order to selectively apply a liquid or not, depending on a particular printing job. While adequate devices exist for moving the anilox roller between an on impression and off impression position, it is always difficult and time consuming to insure a proper positioning of the anilox roller relative to the cylinder in the on impression position so as to transfer a uniform coating of a liquid from the anilox roller to the cylinder. An ongoing need exists for a technique and mechanism to make this necessary alignment easier and more rapid in operation. As a result, production speeds would increase and less skilled personnel are needed to operate the printing unit.

SUMMARY OF THE INVENTION

In accordance with one aspect of the present invention, a printing unit is provided. The printing unit includes a cylinder having a bearer surface at each end thereof and an anilox roller having at least one bearer surface formed thereon. A mounting structure is providing for moving the anilox roller between a retracted position and a transfer position, the bearer surface on the anilox roller engaging one of the bearer surfaces on the cylinder in the transfer position to orient the anilox roller relative the cylinder.

BRIEF DESCRIPTION OF THE DRAWINGS

Exemplary embodiments of the present invention are illustrated in the drawing figures wherein.

DETAILED DESCRIPTION OF THE INVENTION

As used herein, the term "processed" refers to various printing methods which may be applied to either side of a substrate, including the application of UV-curable and aqueous inks and/or coatings. The term "substrate" refers to sheet or web material. Also, as used herein, the term "waterless printing plate" refers to a printing plate having non-image surface areas which are hydrophobic and also having image surface areas which are hydrophilic, wherein the non-image surface areas are characterized by a surface tension value which is less than the surface tension of aqueous ink, and the image surface areas are characterized by a surface tension value which is greater than the surface tension of aqueous ink. "Flexographic" refers to flexible printing plates having a relief surface which is wettable by aqueous ink or aqueous coating material.

Figure 1:
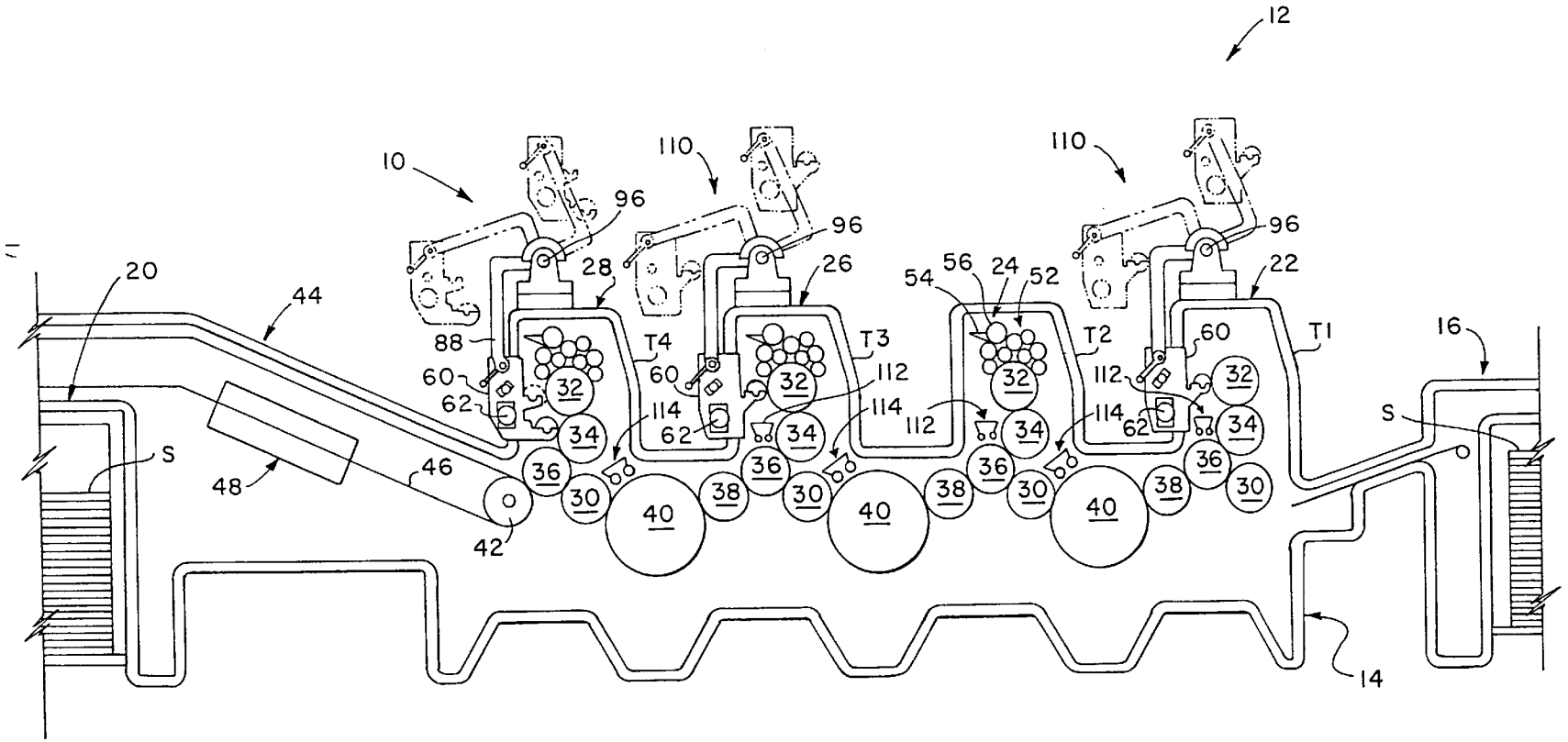
FIG. 1 is a schematic side elevational view of a sheet-fed, rotary offset printing press having inking/coating apparatus embodying the present invention.

As shown in the exemplary drawings, the present invention is embodied in a new and improved in-line inking/coating apparatus 10, for applying inks or protective and/or decorative coatings to sheets or webs printed in a sheet-fed or web-fed, rotary offset or flexographic printing press, herein generally designated 12. In this instance, as shown in FIG. 1, the inking/coating apparatus 10 is installed in a four color printing press 12, such as that manufactured by Heidelberger Druckmaschinen AG of the Federal Republic of Germany under its designation Heidelberg Speedmaster 102V. The press 12 includes a press frame 14 coupled at one end, herein the right end, to a sheet feeder 16 from which sheets, herein designated S, are individually and serially fed into the press, and at the opposite end, with a sheet delivery stacker 20 in which the freshly printed sheets are collected and stacked. Interposed between the sheet feeder 16 and the sheet delivery stacker 20 are four substantially identical rotary offset printing units 22, 24, 26 and 28 which can print different color inks onto the sheets as they are transferred through the press 12. The printing units are housed within printing towers T1, T2, T3 and T4 formed by side frame members 14, 15.

As illustrated, the printing units 22, 24, 26 and 28 are substantially identical and of conventional design. The first printing unit 22 includes an in-feed transfer cylinder 30, a plate cylinder 32, a blanket cylinder 34 and an impression cylinder 36, all supported for rotation in parallel alignment between the press side frames 14, 15. Each of the first three printing units 22, 24 and 26 have an interunit transfer cylinder 38 disposed to transfer the freshly printed sheets from the adjacent impression cylinder to the next printing unit via an interstation transfer cylinder 40. The last printing unit 28 is shown equipped with a delivery cylinder 42 which guides each freshly printed sheet 18 as it is transferred from the last impression cylinder 36 to a delivery conveyor system, generally designated 44, to the sheet delivery stacker 20.

Figure 4:
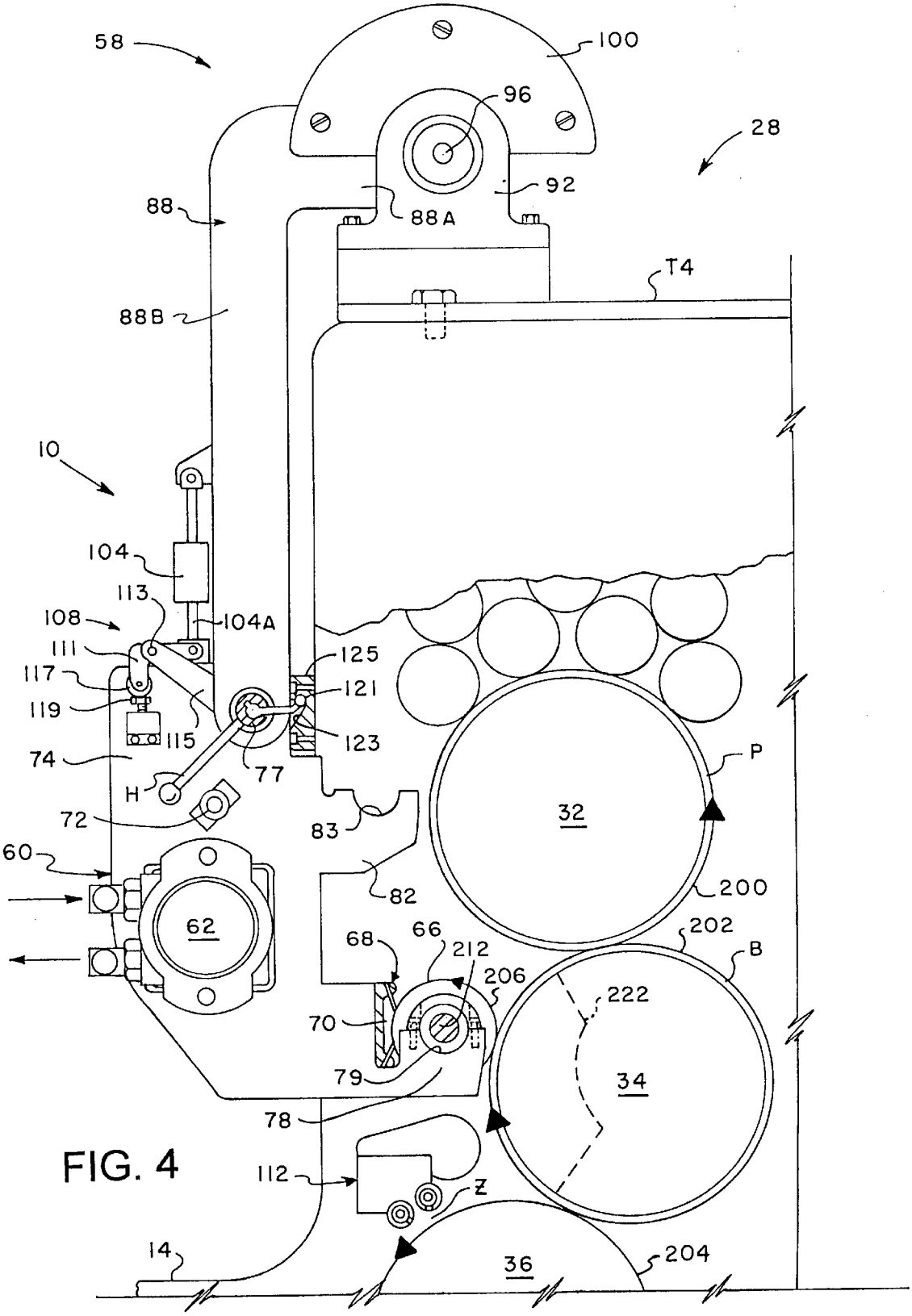
FIG. 4 is a simplified side elevational view showing the dual head inking/coating apparatus in the operative coating position for spot or overall coating from the blanket position.
Figure 5:
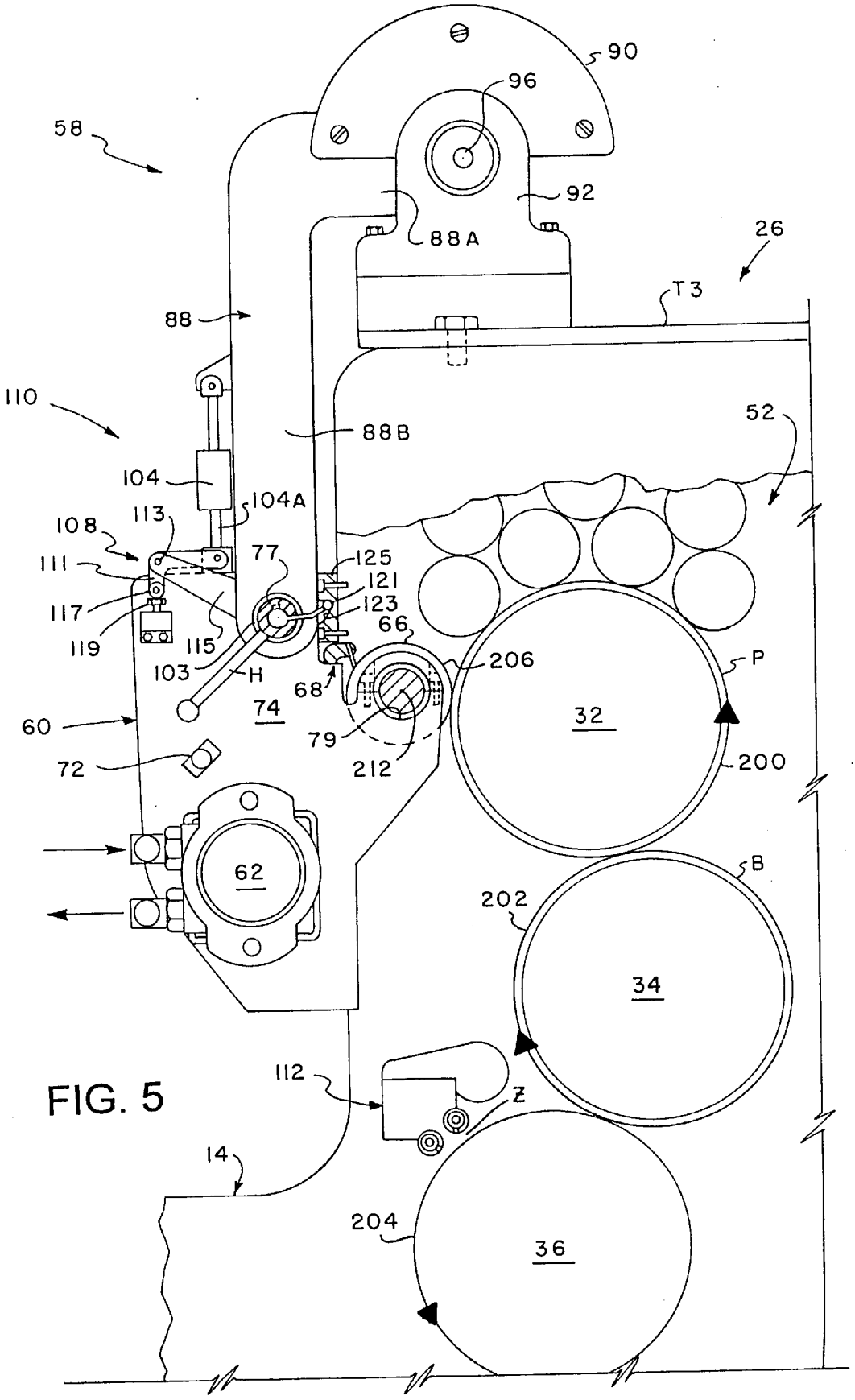
FIG. 5, is a simplified side elevational view showing the single head inking/coating apparatus in the operative coating position for spot or overall coating from the plate position; and, FIG. 6 is a simplified side elevational view of the dual head inking/coating apparatus of FIG. 4, partially broken away, which illustrates the hydraulic drive assembly and doctor blade assembly.
Figure 6:
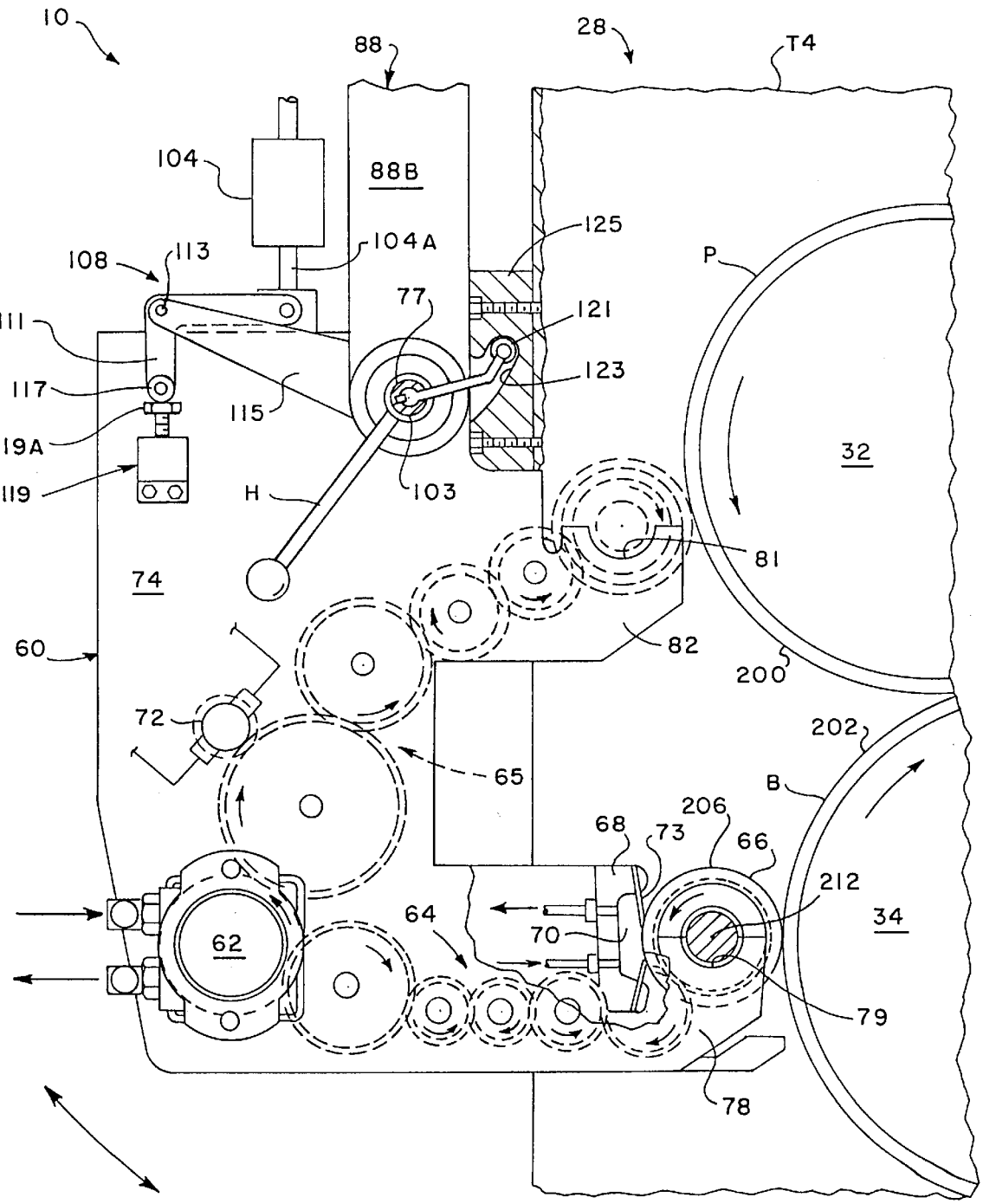

As best seen in FIGS. 4–6, each of the plate cylinders 32, blanket cylinders 34 and impression cylinders 36 have precision machined annular bearers at each end which contacts a similar bearer on the adjacent cylinder. For example, the plate cylinders 32 have annular bearer surfaces 200 at the ends thereof while blanket cylinders 34 have bearer surfaces 202 at the ends thereof The bearer surfaces 200 of the plate cylinder 32 bear directly on the bearer surfaces 202 of the blanket cylinder 34 to provide a constant and repeatable separation between the rotatable axes of the cylinders 32 and 34. Similarly, the impression cylinder 36 has bearer surfaces 204 at the ends thereof which engage the bearer surfaces 202 on the blanket cylinder 34 to establish a constant and repeatable separation between the rotatable axes of these cylinders. With a predetermined separation between the axes of the cylinders, shim plates can be inserted or removed from underneath the printing plate and the blanket to precisely establish the desired relationship between the cylinders to transfer ink to the material being printed. The cylinders are capable of movement apart from each other for cleaning, maintenance and the like. The use of the bearers permits the cylinders to be reengaged with consistency and uniformity.

Figure 2:
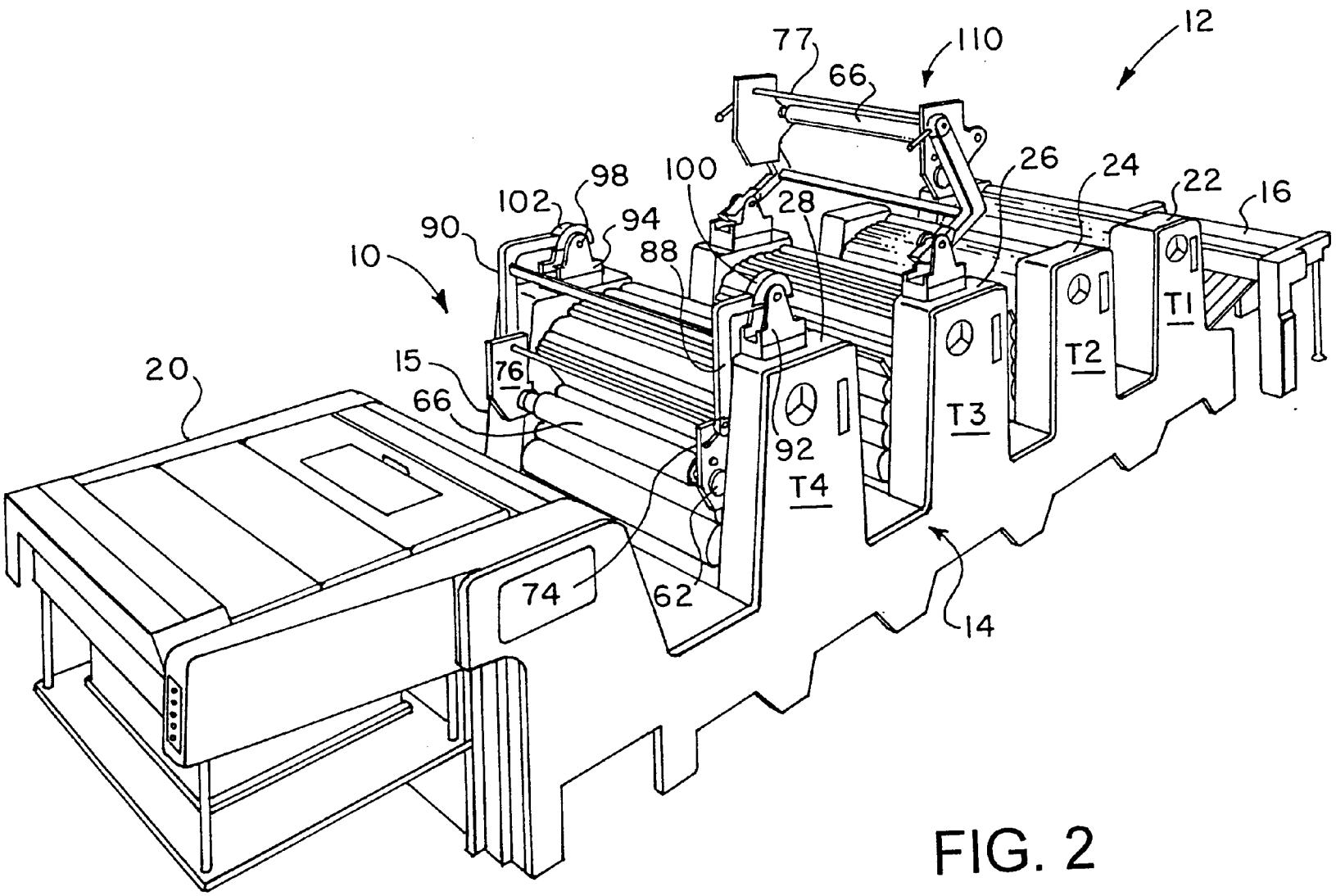
FIG. 2 is a perspective view of the printing press of FIG. 1 in which a dual head inking/coating apparatus is in the operative coating position and a single head coater is in a retracted, overhead position.

The delivery conveyor system 44 as shown in FIG. 2 is of conventional design and includes a pair of continuous delivery gripper chains 46, only one of which is shown carrying at regular spaced locations along the chains, laterally disposed gripper bars having gripper fingers for gripping the leading edge of a freshly printed sheet 18 after it leaves the nip between the delivery cylinder 42 and impression cylinder 36 of the last printing unit 28. As the leading edge is gripped by the grippers, the delivery chains 46 pull the freshly printed sheet away from the impression cylinder 36 and deliver the freshly printed sheet to the sheet delivery stacker 20.

Prior to reaching the delivery sheet stacker, the freshly printed and/or coated sheets S pass under a delivery dryer 48 which includes a combination of infra-red thermal radiation, high velocity hot air flow and heat and moisture extraction for drying the ink and/or the protective/decorative coating on the freshly printed sheets.

In the exemplary embodiment shown in FIG. 1, the first printing unit 22 is equipped with a flexographic printing plate, and does not require an inking roller train or a dampening system. If an ink roller train is mounted on the first printing unit, the form rollers are retracted and locked off when the printing unit goes on impression. Flexographic aqueous ink is supplied by the inking/coating unit 110. The remaining printing units 24, 26 and 28 are equipped for lithographic printing and include an inking apparatus 50 having an inking roller train 52 arranged to transfer ink from an ink fountain 54 to the plate cylinder 32. This is accomplished with the aid of a fountain roller 56 and a ductor roller. The fountain roller 56 projects into the ink fountain 54, whereupon its surface is wetted with printing ink Q. The printing ink Q is transferred intermittently to the inking roller train 52 by the ductor roller. The inking roller train 52 supplies printing ink Q to the image areas of a printing plate P mounted on the plate cylinder 32.

The printing ink Q is transferred from the printing plate P to an ink receptive blanket B which is mounted on the blanket cylinder 34. The inked image carried on the blanket B is transferred to a sheet S as the sheet is transferred through the nip between the impression cylinder 36 and the blanket B.

The inking roller arrangement 52 illustrated in FIG. 1 is exemplary for use in combination with lithographic ink printing plates. It will be understood that dampening rollers (not illustrated) will be in direct engagement with the lithographic plate P, but are not used in combination with the flexographic plate of printing unit 22.

Referring now to FIG. 4, FIG. 5 and FIG. 6, the in-line inking/coating apparatus 10 includes a carriage assembly 58 which supports an applicator head 60. The applicator head 60 includes a hydraulic motor 62, a lower gear train 64, an upper gear train 65, an anilox applicator roller 66 and a doctor blade assembly 68. The external peripheral surface of the applicator roller 66 is inserted into wetting contact with liquid coating material or ink contained in a reservoir 70. The reservoir 70 is continuously supplied with ink or coating which is circulated through the reservoir 70 from an off-press source by a pump (not illustrated). The hydraulic motor 62 drives the applicator roller 66 synchronously with the plate cylinder 32 and the blanket cylinder 34 in response to an RPM control signal from the press drive (not illustrated) and a feedback signal developed by a tachometer 72. While a hydraulic drive motor is preferred, an electric drive motor can be used.

The applicator roller 66 is preferably a fluid metering anilox roller which transfers measured amounts of printing ink or coating material onto the printing plate or blanket. The surface 220 of an anilox roller is engraved with an array of closely spaced, shallow depressions referred to as "cells". Ink or coating material from the reservoir 70 flows into the cells as the anilox roller turns through the reservoir. The transfer surface of the anilox roller is scraped with a doctor blade 73 to remove excess ink or coating. The ink or coating remaining on the anilox roller is the measured amounts contained within the cells.

The applicator roller 66 is cylindrical and may be constructed in various diameters and lengths, containing cells of various sizes and shapes. The volumetric capacity of an anilox roller is established during manufacturing and is dependent upon the selection of cell size, shape and number of cells per unit area. Depending upon the intended application, the cell pattern may be fine (many small cells per unit area) or coarse (fewer larger cells per unit area).

A significant advantage of the applicator roller 66 is the use of bearer surfaces 206 at the ends 208 and 210 thereof which are positioned a distance apart along the axis of rotation 212 of the applicator roller 66 equal to the distance between the bearer surfaces 200 and 202 on the plate cylinder 32 and blanket cylinder 34, respectively. The applicator roller 66 is positioned within the inking/coating apparatus 10 so that the bearer surfaces 206 are aligned with the bearer surfaces 200 and 202. As will be described in greater detail hereinafter, as the applicator roller 66 is moved into engagement with either the plate cylinder 32 or the blanket cylinder 34, the bearer surfaces 206 move into direct contact with either the bearer surfaces 200 or 202 to precisely position the applicator roller 66 relative the plate cylinder 32 or blanket cylinder 34.

Often cylinders, such as plate cylinder 32, blanket cylinder 34 and impression cylinder 3 6, have a gap 222 (FIG. 4) in their surface, perhaps amounting to one-eighth to one-quarter of the total circumference of the cylinder, which is used, for example, to attach the printing plate or blanket to the particular cylinder. In the past, when an applicator roller 66 has been applied against the surface of a plate cylinder or blanket cylinder by a constant force, such as an air cylinder or the like, the applicator roller would have a tendency to drop slightly into the gap and then bounce away from the cylinder as the roller comes to the end of the gap. This has caused a lack of coating on the first portion of the substrate or sheet being coated. By using an applicator roller 66 having bearers mated with the bearers on the cylinders, this bounce is eliminated as the bearer surfaces are in constant contact.

While typical bearers on plate cylinders, blanket cylinders and impression cylinders are formed of hardened steel, the bearer surfaces 206 on the applicator roller 66 can be made out of metal, hard plastic, such as Delrin, or other suitable material that adequately positions the applicator roller 66 consistently relative to the cylinders 32 or 34.

By applying the ink or coating material through the inking/coating applicator head 60, more ink or coating material can be delivered to the sheet S as compared with the inking roller train of a lithographic printing unit. Moreover, color intensity is stronger and more brilliant because the flexographic ink is applied at a much larger film thickness than can be applied by the lithographic process and is not diluted by dampening solution.

The inking/coating applicator head 60 includes side frame members 74, 76 that support the applicator roller 66, gear train 64, gear train 65, doctor blade assembly 68 and the drive motor 62. The applicator roller 66 is supported at opposite ends on a lower cradle formed by a pair of end plates 78, 80 which hold the applicator roller 66 in parallel alignment with the blanket cylinder 34 (FIG. 5). The side frames 74, 76 are also provided with an upper cradle formed by a pair of side plates 82, 84 which are vertically spaced with respect to the lower side plates 78, 80. Each cradle has a pair of sockets 79, 81 and 83, 85, respectively, for holding the applicator roller 66 for spot coating or inking engagement against the plate P of the plate cylinder 32 (FIG. 4) or the blanket B of the blanket cylinder 34.

Preferably, the applicator roller 66 for the upper cradle (plate) position is an anilox roller having a resilient transfer surface. In the dual cradle arrangement, the press operator can quickly change over from blanket inking/coating and plate inking/coating with minimum press down time, since it is only necessary to remove and reposition or replace the applicator roller 66, and wash-up the doctor blade assembly if changing from ink to coating or vice versa. The capability to selectively operate in either the flexographic mode or the lithographic mode and to print or coat from either the plate or blanket position is referred to herein as the "LITHOFLEX" process.

Figure 3:
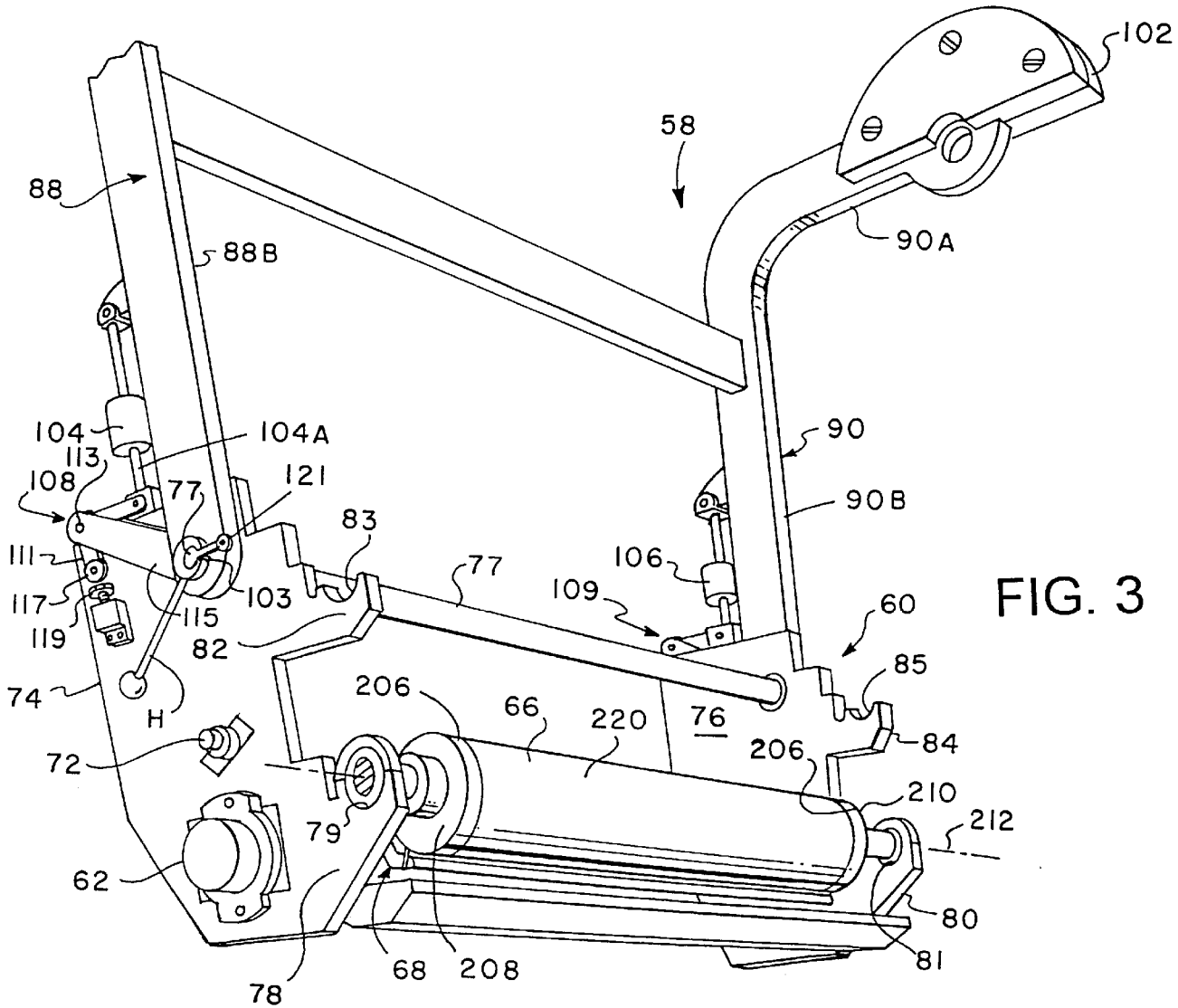
FIG. 3 is an enlarged simplified perspective view showing one side of the single head inking/coating apparatus of FIG. 1 in the operative position.

Referring again to FIG. 2 and FIG. 3, the applicator head 60 is supported by the carriage assembly 58 in a cantilevered, pivotal arrangement which allows the dual cradle inking/coating apparatus 10 and a single cradle inking/coating apparatus 110 to be used between any two adjacent printing units, as well as used on the first and last printing units of the press. This is made possible by a pair of cantilevered support arms 88, 90 that are pivotally coupled to the side plates 74 76, respectively, on a pivot shaft 77. Each support arm has a hub portion 88A, 90A, respectively, and an elongated shank portion 88B, 90B, respectively.

The cantilevered support arms are pivotally mounted on the printing tower by pivot blocks 92, 94, respectively. The hub portions 88A, 90A are journalled for rotation on pivot shafts 96, 98, respectively. The pivot blocks 92, 94 are securely fastened to the tower 14D, so that the carriage assembly 86 is pivotally suspended from the pivot shafts 96, 98 in a cantilevered Ferris support arrangement. The shank portions 88B, 90B are pivotally coupled to the pivot shaft 77, so that the carriage assembly 58 and the applicator head 60 are capable of independent rotation with respect to each other and with respect to the pivot shaft 77. By this arrangement, the applicator head 60 is pivotally suspended from the pivot shaft 77, and remains in an upright orientation as the support arms rotate from the operative position to the fully retracted position, and vice versa.

Thus, the cradles 78, 80 and 82, 84 position the applicator roller 66 in vertical and horizontal alignment with the plate cylinder or blanket cylinder when the applicator head is extended to the operative position, for example as shown in FIG. 4 and FIG. 5. Moreover, because of the transverse relationship between the hub portion and shank portion of the support arms, the applicator head 60 and carriage assembly 58 are capable of rotating through a Ferris arc without touching the adjacent printing tower. This makes it possible to install the inking/coating apparatus 10 on any intermediate printing unit tower (T2, T3), and as well as on the first printing unit tower T1 and the last printing unit tower T4. Additionally, when the inking/coating unit 10 is in the operative position, the lateral projection of the applicator head 60 into the interstation space between printing units is minimized. This assures virtually unrestricted operator access to the interstation space between adjacent printing units when the applicator head is engaged in the operative position, and completely unrestricted access when the carriage assembly 58 is retracted.

Rotation of the carriage assembly 58 is counterclockwise from the retracted, idle position (shown in phantom in FIG. 1) to the operative position (FIG. 4 and FIG. 5). The carriage assembly 58 can be adapted for clockwise rotation from the retracted position to the operative position for engagement of the applicator roller to either the plate or the blanket on the dampener side of the tower, assuming that access to the plate and blanket is not restricted by dampener rollers or the like.

Rotational movement of the support arms 88, 90 is assisted by counterweights 100, 102 which are secured to the support arms, respectively, for concurrent rotation with respect to the pivot blocks 92, 94. With the passive assistance of the counterweights, the press operator can easily move the inking/coating assembly 10 from the engaged operative position as shown in FIG. 4 to the fully retracted, idle position as shown in phantom in FIG. 1. Preferably, rotation of the carriage assembly 58 is assisted by a torsion spring, electric motor or hydraulic motor.

The inking/coating apparatus 10 is releasably locked into the operative position as shown in FIG. 4 by releasable latch couplings 103, 105 that secure the support arms 88, 90 to the press side frames 14, 15, respectively, of the printing unit tower T4 in the operative position. Coating engagement of the bearer surfaces 206 of applicator roller 66 against the bearer surfaces 202 of blanket cylinder 34 is produced by power actuators, preferably pneumatic cylinders 104, 106 which have extendable/retractable power transfer arms 104A, 106A, respectively. The pneumatic cylinder 104 is pivotally coupled to the support arm 88 by a pivot linkage 108, and the second pneumatic cylinder 106 is pivotally coupled to the support arm 90 by a pivot linkage 109. In response to actuation of the pneumatic cylinders 104, 106, the power transfer arms are retracted. As the transfer arms retract, the inking/coating head 60 is rotated counterclockwise on the pivot shaft 77, thus moving the applicator roller 66 into coating engagement with the blanket cylinder 34 by forcing the bearer surfaces 206 against bearer surfaces 202.

The pivot linkage 108 includes a bell crank 111 which is mounted for pivotal movement on a pin 113. The pin 113 is supported by a clevis plate 115 which is attached to the support arm 88. One end of the bell crank is pivotally coupled to the actuator arm 104A, and a cam roller 117 is mounted for rotation on its opposite end.

The cam roller 117 is engagable against an adjustable stop 119 which is rigidly secured to the side plate 74. Counterclockwise shifting of the handle H moves a cam follower 121 into a latch pocket 123 of a receiver block 125 as the cam roller 117 is moved into engagement with the adjustable stop 119 in the interlocked, operative position. Referring to FIG. 4, FIG. 5 and FIG. 6, the receiver block 125 is secured to the delivery side of the printing unit tower by machine screws.

When the plate P goes on impression, power is applied to the pneumatic actuator 104 and the power transfer arm 104A retracts, thus causing the bell crank 111 to rotate counterclockwise about the pin 113. The torque applied by the pneumatic actuator 104 is transmitted to the applicator head 60 through the cam roller 117 and the adjustable stop 119. Counterclockwise movement of the applicator head 60 relative to the support shaft 77 carries the applicator roller 66 into engagement with the plate P.

The adjustable stop 119 has a threaded bolt 119A which is engagable with the cam roller 117. The striking point of engagement is preset so that the bearer surface 206 of the applicator roller 66 is properly positioned to engage the bearer surfaces 202 or 204 of the plate P or blanket B in the operative position to precisely position the applicator roller 66 relative the cylinder when the applicator head 60 is interlocked with the press frame 14 and the printing unit goes on impression.

If desired, the structure, such as stop 119, bolt 119A and the like, can be eliminated and the position of the applicator roller 66 be set by simply activating cylinders 104 until bearer surfaces 206 engage either bearer surfaces 202 or bearer surfaces 204 and then maintaining sufficient force in cylinders 104 to maintain the bearer surfaces in continuous contact.

Referring to FIG. 5, an inking/coating apparatus 110 having a single head is illustrated. The construction of this alternative embodiment is identical in all respects with the dual head arrangement, with the exception that only a single gear train and a single cradle for holding the applicator roller is provided. In both embodiments, the inking/coating head 60 remains upright as it swings through an arc, comparable to the movement of a Ferris wheel. Because of the upright orientation of the inking/coating head 60 as it moves between the extended and retracted positions, the usual platform spacing between printing unit towers provides adequate clearance to permit extension and retraction of the carriage assembly 58 without interference with operator access to the printing units. This is a significant advantage in that it permits the in-line inking/coating apparatus 10 to operate effectively in the interstation space between any adjacent printing units, and without blocking or obstructing access to the cylinders of the printing units when the inking/coating apparatus is in the retracted position (as indicated in phantom in FIG. 1).

Moreover, when the in-line inking/coating apparatus is in the fully retracted position, the applicator roller 66 is conveniently positioned on the dampener side of the printing unit for inspection, clean-up or replacement. Additionally, the doctor blade assembly is also conveniently positioned for inspection, removal, adjustment or clean-up. Also, the doctor blade reservoir and coating circulation lines can be cleaned while the press is running as well as when the press has been stopped for change-over from one type of ink or coating material to another.

When the inking/coating apparatus is used for applying an aqueous ink or an aqueous coating material, the water component on the freshly printed sheet S is evaporated by a high velocity, hot air interstation dryer and high volume heat and moisture extractor units 112 and 114, as shown in FIG. 1, FIG. 4 and FIG. 5. The dryer/extractor units 112 and 114 are oriented to direct high velocity heated air onto the freshly printed/coated sheets as they are transferred by the interunit and the intermediate transfer cylinders 36, 40. By this arrangement, the freshly printed aqueous ink or coating material is completely dry before the sheet is overprinted in the next printing unit.

The high velocity, hot air dryer and high performance heat and moisture extractor units 112, 114 utilize high velocity air jets which scrub and break-up the moist air level which clings to the surface of each freshly printed sheet. Within each dryer, high velocity air is heated to a high temperature as it flows across a resistance heating element within an air delivery baffle tube. High velocity jets of hot air are discharged through multiple airflow apertures through an exposure zone Z (FIG. 4 and FIG. 5) onto the freshly printed/coated sheet S as it is transferred by the transfer cylinder 36 and intermediate transfer cylinder 40, respectively. Each dryer assembly includes a pair of air delivery dryer heads which are arranged in spaced, side-by-side relation as shown in FIG. 4 and FIG. 5.

The high velocity, hot moisture-laden air displaced from each freshly printed sheet is extracted from the dryer exposure zone Z and completely exhausted from the printing unit by the high volume extractors. Each extractor head includes a manifold coupled to the dryer heads and draws the moisture, volatiles and high velocity hot air through a longitudinal gap between the dryer heads. According to this arrangement, each printed sheet is dried before it is run through the next printing unit.

The water-based inks used in flexographic printing dry at a relatively moderate drying temperature provided by the interstation high velocity hot air dryers/extractors 112, 114. Consequently, print quality is substantially improved since the aqueous ink is dried at each printing unit before it enters the next printing unit. Moreover, back-trapping on the blanket of the next printing unit is completely eliminated. This interstation drying arrangement makes it possible to print aqueous inks such as metallic ink and opaque white ink at one printing unit, and then overprint at the next printing unit.

This arrangement also permits the first printing unit to be used as a coater in which an aqueous coating is applied to low grade paper, for example recycled paper, to trap and seal in lint, dust, spray powder and other debris and provide a smoother, durable surface that can be overprinted in the next printing unit. The first down coating seals the surface of the low grade, rough substrate and improves overprinted dot definition while preventing strike-through and show-through. A UV-curable protective and/or decorative coating can be applied over the first down overprinted (aqueous) coating in the last printing unit. EPDM is known to be completely acceptable for use with UV-curable inks and coating applications.

A demonstration resilient anilox roller was made by covering a steel core with about ½ inch of rubber to a diameter of about four inches. The rubber had a hardness of about 80 on the Shore "A" scale. The surface was laser engraved by Consolidated Engravers, 2255 West Longhorn Dr., Lancaster, Tex. 76134 with four different patterns in approximately 10 inch wide bands across the face comprising about 125,150,175 and 200 lines/inch with what was a "hexagonal" cell pattern. Satisfactory coatings were applied via the plate cylinder to a substrate with all four patterns. A second resilient anilox roll was obtained which had only one 150 lines/inch overall pattern with a cell volume of about 9 cubic billion microns (CBM). Satisfactory coating was applied from this roll against a plate. Coating was applied to the roll by a sealed doctor blade assembly like assembly 68 in FIG. 6. The roller produced useful film weight. Water based inks were applied satisfactorily in various colors. The surface speed of the plate and resilient anilox rollers were kept about the same. No reason is seen why a roller train similar to fountain assembly 69 in FIG. 8 could not be used to supply coating to a resilient anilox roller 66. The resilient anilox roller will accommodate slight variations in elevation for a printing plate or blanket much better than a ceramic or hard surface anilox roller.

Preferably, the applicator roller 66 is constructed of metal or ceramic when it is used for applying a coating material to the blanket B on the cylinder 34. When the applicator roller 66 is applied to the plate, it is preferably constructed as an anilox roller having a resilient transfer surface for engaging a flexographic printing plate with the bearer surfaces 206 made of a harder material such as a plastic, for example, Delrin, or a metal. Suitable resilient roller surface materials include Buna N synthetic rubber and EPDM (terpolymer elastomer).

It will be appreciated that the inking/coating apparatus 10 is capable of applying a wide range of ink types, including fluorescent (Day Glo), pearlescent, metallics (gold, silver and other metallics), glitter, scratch and sniff (micro-encapsulated fragrance), scratch and reveal, luminous, pressure-sensitive adhesives and the like.

The press operator can eliminate the dampener roller assembly altogether, and the inking/coating apparatus 10 can selectively apply aqueous inks and coatings to a flexographic or waterless printing plate and the blanket. Moreover, overprinting of the aqueous inks and coatings can be carried out in the next printing unit since the aqueous inks and coatings are completely dried by the high velocity, hot air interstation dryer and high volume heat and moisture extractor assembly.

The aqueous inks and coatings as used in the present invention contain colored pigments and/or soluble dyes, binders that fix the pigments onto the surface of the printed sheet, and waxes, defoamers and thickeners. Aqueous printing inks predominantly contain water as a solvent, diluent and/or vehicle. The thickeners which are preferred include algonates, starch, cellulose and its derivatives, for example cellulose esters or cellulose ethers and the like. Coloring agents including organic as well as inorganic pigments may be derived from dyes which are insoluble in water. Also, the printing ink may contain water and can be predominantly glycol or the like, with the pigment being bound by an appropriate resin. When metallic inks are printed, the cells of the anilox roller must be appropriately sized to prevent the metal particles from getting stuck within the cells. The cell size is critical, and for metallic gold ink, the anilox roller should have a screen line count in the range of 175–300 lines per inch (69–188 lines per cm).

The inking/coating apparatus 10 can also apply UV-curable inks and coatings. If UV-curable inks and coatings are utilized, ultra-violet dryers/extractors are installed adjacent the high velocity hot air dryer/extractor units 112, 114, respectively.

It will be appreciated that the inking/coating apparatus 10 described herein makes it possible to selectively operate a printing unit in either the flexographic printing mode or the lithographic printing mode, while also providing the capability to print or coat from either the plate or blanket position. The dual cradle support arrangement of the present invention makes it possible to quickly change over from inking/coating at the blanket cylinder position to inking/coating at the plate cylinder position with minimum press down-time, since it is only necessary to remove and reposition or replace the applicator roller 66 while the printing/inking apparatus is in the retracted position.

Moreover, the press operator may elect to spot or overall coat with aqueous ink/coating from the plate during one job, and then spot and/or overall coat from the blanket during the next job. Since the doctor blade assembly can be flushed and washed-up quickly and the applicator roller can be replaced quickly, it is possible to spot coat or overall coat from the plate position or the blanket position with aqueous inks or coatings during the first press run and then spot coat or overall coat with UV-curable inks or coatings from the plate position or from the blanket position during the next press run. The inking/coating apparatus 10 is completely out of the way in the retracted position; consequently, the doctor blade reservoir and supply lines can be flushed and washed-up by automatic wash-up equipment while the printing unit is printing another job.

The positioning of the applicator head and roller assembly relative to the plate and blanket is repeatable to a predetermined, preset impression position due to the positive contact between bearer surfaces 206 on applicator roller 66 and the bearer surfaces 202 on plate cylinder 32 or bearer surfaces 204 on blanket cylinder 34. Consequently, no printing unit adjustment or alteration is required, except for flushing the doctor blade assembly and cleaning or replacing the applicator roller to accommodate a different kind of ink or coating material. Although manual extension and retraction have been described in connection with the exemplary embodiment, extension to the operative position and retraction to a non-operative idle position can be carried out automatically by hydraulic or electric motor servornechanisms.

The Ferris wheel support arrangement allows the inking/coating apparatus to operate effectively in the interstation space between any adjacent printing units, as well as on the first or last printing units of the press, without blocking or obstructing the interstation space or restricting operator access to the cylinders of any of the printing units.

Finally, because the inking/coating apparatus of the present invention is mounted on a printing unit tower and is extendable to the operative position without requiring adjustment or alteration of the printing unit cylinders, it can be used for applying printing ink or coating material to the blanket cylinder of a rotary offset web press, or to the blanket of a dedicated coating unit.

I claim:

1. A printing unit of the type having at least one offset lithographic printing station, comprising:

an offset plate cylinder mounted for rotation about a first axis of rotation, the plate cylinder have a plate supporting surface and a bearer on each side of the plate supporting surface, said bearers being located at a radial distance with respect to the first axis of rotation and having a continuous bearer surface; which rotates with the offset plate cylinder an anilox roller for applying ink or coating to a plate on the plate cylinder, the anilox roller having a central surface portion adapted for applying ink or coating to a plate, the anilox roller having laterally spaced end portions outside the central portion with concentrically located bearers on each end portion, the bearers having a continuous bearer surface adapted to engage one of the bearers on the plate cylinder; and an anilox mounting structure mounting the anilox roller for rotation about a second axis, and for movement of the anilox roller relative to the plate cylinder between a retracted position and an engaged position, wherein the bearer surfaces of the anilox roller are brought into contact with the bearer surfaces of the plate cylinder to repeatably set the anilox roller at a desired position relative to the plate cylinder, to prevent the anilox roller from bouncing and thereby creating printing defects when it reaches a gap area in the printing cylinder.

2. The printing unit of claim 1 wherein the anilox roller has a resilient surface for applying the ink or coating.

3. A printing unit of the type having at least one offset lithographic printing station, comprising:

an offset blanket cylinder mounted for rotation about a first axis of rotation, the blanket cylinder have a blanket supporting surface and a bearer on each side of the blanket supporting surface, said bearers being located at a radial distance with respect to the first axis of rotation and having a continuous bearer surface; which rotates with offset blanket cylinder an anilox roller for applying ink or coating to a blanket on the blanket cylinder, the anilox roller having a central surface portion adapted for applying ink or coating to a blanket, the anilox roller having laterally spaced end portions outside the central portion with concentrically located bearers on each end portion, the bearers having a continuous bearer surface adapted to engage one of the bearers on the plate cylinder; and an anilox mounting structure mounting the anilox roller for rotation about a second axis, for movement of the anilox roller relative to the blanket cylinder between a retracted position and an engaged position, wherein the bearer surfaces of the anilox roller are brought into contact with the bearer surfaces of the blanket cylinder to repeatably set the anilox roller at a desired position relative to the blanket cylinder, to prevent the anilox roller from bouncing and thereby creating printing defects when it reaches a gap area in the blanket cylinder.

4. The printing unit of claim 3 wherein the anilox roller has a resilient surface for applying the ink or coating.

5. A method of applying a liquid to a printing plate on an offset plate cylinder being rotated on an axis of rotation in a printing press, comprising:

providing an offset plate cylinder mounted for rotation on a first axis, the plate cylinder having opposite end portions wherein the end portions have concentric bearer having a continuous bearer surface;

providing an anilox roller mounting structure for mounting an anilox roller for rotation about a second axis and for movement of the anilox roller relative to the plate cylinder between a retracted position and an engaged position with a plate;

providing an anilox roller with a central portion for applying liquid to a plate on the plate cylinder, wherein the anilox roller has end portions outside the central portion with a concentrically located bearer on each end portion, having a continuous bearer surface adapted to engage a corresponding bearer surface on the plate cylinder;

rotating the anilox roller in contact with a liquid to be applied to a plate on the plate cylinder;

moving the mounting structure to bring the bearers on the anilox roller into engagement with the bearers on the plate cylinder; and rotating the anilox roll and plate cylinder while maintaining the bearers in a rolling engagement to prevent printing defects created when the anilox roller traverses a gap in the plate cylinder.

6. The method of claim 5 wherein the step of providing an anilox roller comprises the step of providing an anilox roller with a resilient surface.

7. A method of applying a liquid to a printing blanket on an offset blanket cylinder being rotated on an axis of rotation in a printing press, comprising:

providing an offset blanket cylinder mounted for rotation on a first axis, the blanket cylinder having opposite end portions wherein the end portions have concentric bearers having a continuous bearer surface;

providing an anilox roller mounting structure for mounting an anilox roller for rotation about a second axis and for movement of the anilox roller relative to the blanket cylinder between a retracted position and an engaged position with a blanket;

providing an anilox roller with a central portion for applying liquid to a blanket on the blanket cylinder, wherein the anilox roller has end portions outside the central portion with a concentrically located bearer on each end portion, having a continuous bearer surface adapted to engage a corresponding bearer surface on the blanket cylinder;

rotating the anilox roller in contact with a liquid to be applied to a blanket on the blanket cylinder;

moving the mounting structure to bring the bearers on the anilox roller into engagement with the bearers on the blanket cylinder; and rotating the anilox roll and blanket cylinder while maintaining the bearers in a rolling engagement to prevent printing defects created when the anilox roller traverses a gap in the blanket cylinder.

8. The method of claim 7 wherein the step of providing an anilox roller comprises the step of providing an anilox roller with a resilient surface.

* * * * *

UNITED STATES PATENT AND TRADEMARK OFFICE

CERTIFICATE OF CORRECTION

PATENT NO. : 6,082,257
DATED : July 4, 2000
INVENTOR(S) : Howard C. Secor

It is certified that error appears in the above-identified patent and that said Letters Patent is hereby corrected as shown below:

Column 10,
Line 58, delete semicolon after "surface"
Line 59, insert semicolon after "cylinder"

Column 11,
Line 20, delete semicolon after "surface"
Line 21, insert semicolon after "cylinder"
Line 29, replace "plate" with -- blanket --.
Line 50, replace first occurrence of "bearer" with --bearers --

Column 12,
Line 14, replace "roll" with -- roller --.
Line 47, replace "roll" with -- roller --.

Signed and Sealed this

Seventh Day of August, 2001

*Attest:*

Nicholas P. Godici

*Attesting Officer*

NICHOLAS P. GODICI
*Acting Director of the United States Patent and Trademark Office*